United States Patent [19]

Scott

[11] 4,113,096

[45] Sep. 12, 1978

[54] PACKING BOX FOR CHINA

[75] Inventor: Donald M. Scott, La Habra, Calif.

[73] Assignee: Fibre Containers Company, City of Industry, Calif.

[21] Appl. No.: 737,600

[22] Filed: Nov. 1, 1976

[51] Int. Cl.[2] ..... B65D 81/02; B65D 85/30

[52] U.S. Cl. ..... 206/523; 206/586

[58] Field of Search ..... 206/453, 424, 472, 586–590, 206/523; 229/40

[56] References Cited

U.S. PATENT DOCUMENTS

| | | | |
|---|---|---|---|
| 1,720,889 | 7/1929 | Eshleman | 206/587 |
| 3,113,667 | 12/1963 | Knapp | 206/523 |
| 3,302,782 | 2/1967 | Pezely, Jr. | 206/453 |
| 3,339,722 | 9/1967 | Antwerpen | 206/453 |
| 3,394,862 | 7/1968 | Greene et al. | 206/453 |
| 3,655,034 | 4/1972 | Stollman et al. | 206/586 |
| 3,664,573 | 5/1972 | Partain | 206/586 |
| 3,790,065 | 2/1974 | Carpenter | 206/586 |
| 3,791,571 | 2/1974 | Pilz | 206/586 |
| 3,809,311 | 5/1974 | Fohrman et al. | 206/586 |
| 3,939,978 | 2/1976 | Thomaswick | 206/453 |

*Primary Examiner*—Herbert F. Ross
*Attorney, Agent, or Firm*—Christie, Parker & Hale

[57] ABSTRACT

A packing box for storage and shipment of a single dish or plate. A pair of cushioning blocks each having an indentation for insertion of an edge segment of a dish or plate, are oppositely aligned along interior sides of a container. The container maintains the relative alignment of the cushioning blocks and dish to protect from or mitigate the effects of external shocks.

1 Claim, 10 Drawing Figures

PACKING BOX FOR CHINA

BACKGROUND OF THE INVENTION

1. Field of the Invention

The present invention relates to packing boxes for shipping and storage. In particular, it relates to packing boxes for items of china and the like such as dishes or plates, which serve to protect the item contained therein from damage due to rough handling, etc., and the like.

2. Description of the Prior Art

Plates bearing inscriptions or ornamental designs are of great value and often serve as highly prized gifts and souvenirs. Frequently such items are purchased for shipment from a store offering wrapping assistance in conjunction with the goods. As such goods are often fragile, a protective shipment container is a necessity. A simplified packaging method for shipping such items is also advantageous, for such a method may be practiced by the purchaser or utilized for reshipment of a valuable decorative plate purchased in the past. Common methods employed in the past have included the wrapping of such items in newspaper or shredded scrap paper for insulation from handling shocks. The use of a completely enclosing mold of Stryrofoam or like material has also been employed. An additional solution has been the manufacture of containers incorporating a secondary enclosure or partition for the plate within the main shipping container. Such an enclosure may be constructed of the same material as the container, such as corrugated or like variety of cardboard.

All of the above-mentioned methods have met with varying degrees of success. In general, it has been found that those methods which assure the greatest protection of the plate involve a measure of "overkill." That is, an excessive amount of packing material is utilized in the case of full enclosure by the Stryofoam type cushioning material or a complex container design frequently is encountered when the plate is retained within a secondary partition of the main container. The advantages of scrap paper as a cheap cushioner are offset by the fact that such material is often dangerous to store, creating both storage and disposal problems, especially in the case of a heavy volume user such as a commercial establishment. The reusability of such materials is quite limited.

SUMMARY OF THE INVENTION

The present invention essentially comprises a container enclosing a pair of blocks of cushioning material. The blocks each have an indentation in a side to accommodate a plate or dish at its edge. The blocks are formed so that they will fit tightly against sides of the shipping container. The indentations cooperate with the interior dimensions of the shipping container so that the plate is maintained rigidly in a fixed, yet cushioned, position relative to the sides, top and bottom of the container, making no contact directly therewith.

OBJECTS OF THE INVENTION

An object of the present invention is to provide a protective packing box for a plate which requires a minimum usage of cushioning material.

Another object of this invention is to provide a packing box for a plate which maintains the plate separate and apart from the exterior container of the box throughout a large percentage of the plate surface area and provides cushioning material intermediate the points of indirect contact between the container and the plate.

Still another object of the invention is to provide a packing box suitable for shipping a dish or the like which is readily reuseable.

Yet still another object of this invention is to provide a packing box for a dish or the like whose component parts minimize storage problems in terms of volume and combustion hazards.

Other objects, advantages and features of the present invention will be readily apparent from the following detailed description wherein like numerals represent like features throughout.

DESCRIPTION OF THE PREFERRED EMBODIMENT

Figure 1:
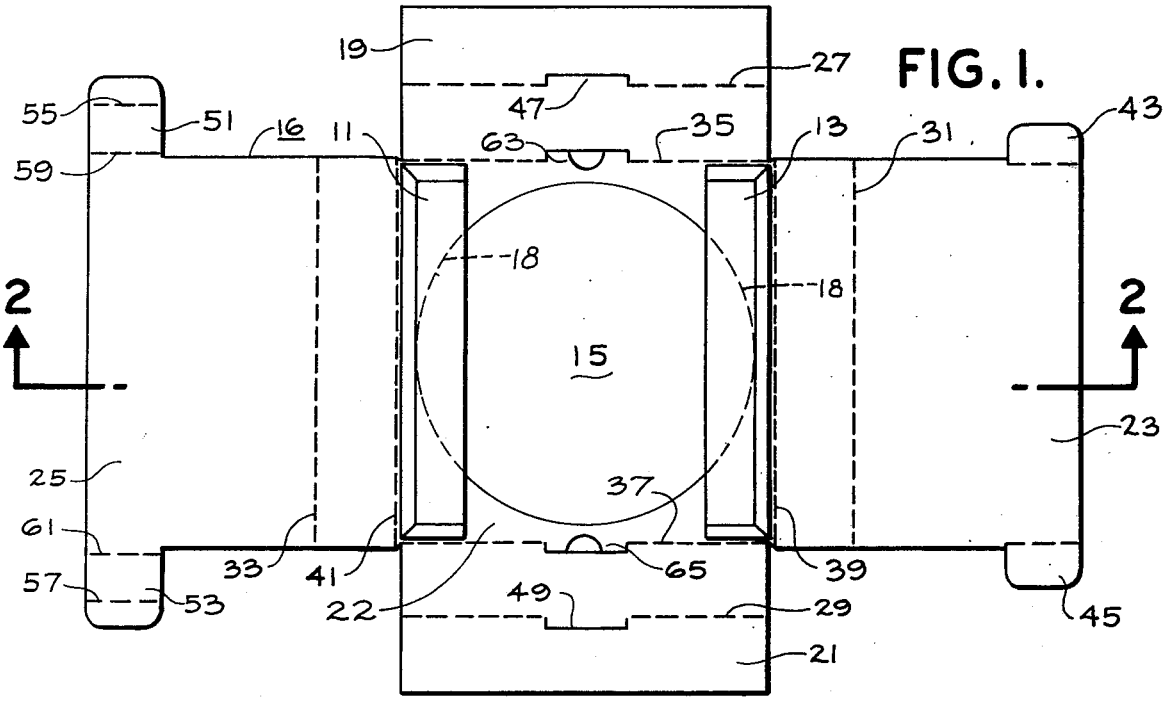
FIG. 1 is a plan view of a self-closing packing box in layout incorporating a presently preferred embodiment of the invention.
Figure 10:
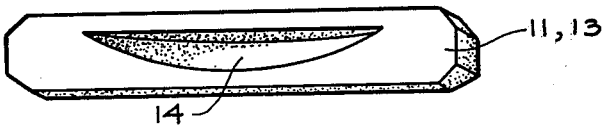
FIG. 10 is a view of one of the cushioning blocks of the present invention showing the plate retaining indentation therein.

The packing box of FIG. 1 is seen to include a first cushioning block 11 and a second cushioning block 13 each having an indentation 14, as seen in FIG. 10, to accommodate an edge segment of a dish or plate 15. The indentation 14 is designed to accommodate the plate 15 in a close-fitting relationship. The cushioning blocks 11, 13 are constructed of material which will provide sufficient resilience to cushion the plate 15 from external shocks to its container 16 while tightly retaining the plate 15 at its edge. No additional contact, direct or indirect, exists between the plate 15 and the packing box. Thus, a combination of suspension and cushioning serves to protect plate 15. Materials which give excellent cushioning results include expanded polystyrene foam and the like. The packing box of the present invention comprises an enclosing container 16 which, in the embodiment of FIGS. 1 and 2, is of the "self-closing" type.

The "self-closing" container is shown in FIG. 1 in its expanded or layout form. In FIG. 2, a section of the assembled unit has been taken along line 2—2 of FIG. 1 to more clearly show the interaction of the cushioning blocks 11, 13 with the dish or plate 15 being shipped or stored with the packing box. Assembly is readily accomplished manually or by machine. No special skill is required of the assembler. The "self-closing" container 16 may be formed of a single piece of container material. The material may be any of a number of flat foldable varieties commonly employed for such applications, including various cardboards, plastics and the like. The outline and folds of the unfolded container 16 may be produced by any of a multitude of conventional stamping and scoring processes.

Figure 2:
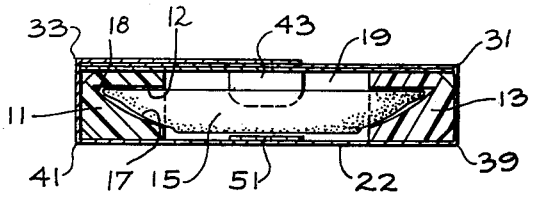
FIG. 2 is a sectional view of the embodiment of FIG. 1 as fully assembled, taken along the line 2—2 of FIG. 1.

The container 16 of FIGS. 1 and 2 comprises a matching second side flap 21 at opposite ends of a square bottom panel 22 of the container. First end flap 23 and second end flap 25 are likewise oppositely disposed about the edges of the bottom pannel 22. Fold lines 27, 29, 31 and 33 may be seen in FIG. 2 to define the side-to-top transition points of the container located an appropriate distance within each of the flaps. Edge fold lines 35, 37, 39, 41 exist to facilitate the bending of the flaps at the points of attachment of the flaps to the bottom pannel 22 and define bottoms of the sides of the folded-up container as seen in FIG. 2.

A pair of tabs 43, 45 exists along the edges of first end flap 23. These tabs interact with the slots 47, 49 in side flaps 19, 21 when the container is fully assembled as shown in FIG. 2. Tabs 51, 53, which are attached to second end flap 25, are longer than the tabs 43 45 to enable the tabs to engage slots 63, 65 which lie along attachment fold lines 35 and 37. The disparity in length of tabs is occassioned by the fact that the points of engagement for these tabs in the folded configuration lie beneath those for the former tabs by an amount approximately equal to the height of the folded container's sides.

Each of the two second end flap tabs 51, 53 is seen to have a mid-tab fold line 55, 57 and a tab attachment fold line 59, 61. These fold lines are required for the attainment of a tab which, when folded, will have a segment parallel to the side of the container for a sufficient distance to enable it to span the height of that side and, upon attainment of that distance, terminate in a portion perpendicular thereto. This enables the tabs 53, 57 to enter and engage the slots 63, 65.

To assemble the packing box of FIG. 1, one may proceed to fold container 16 around the combined plate 15 — cushioning block 11, 13 assembly or simply assemble the container 16 for later insertion of the above-mentioned three piece assembly. If the cushioning blocks 11, 13 and plate 15 are to be included from the start, this unit is preferably initially placed upon bottom panel 22, achieving the configuration of FIG. 1. Side flaps 19, 21 are next folded to a position perpendicular to bottom panel 22 along edge fold lines 35, 37. Further 90° folds are made at fold lines 27, 29 to position each side flap into a folded container "side" and "top" segment.

First end flap 23 is folded 90° at edge fold line 39 and an additional 90° at fold line 31, forming that flap into a container "side" and a "top" portion. The sequence of assembly provides that the container "top" portion formed from first end flap 23 will overlay each of the container "top" portions formed of side flaps 19, 21. Each of the tabs 43, 45 attached to first end flap 23 may now be folded 90° for engagement of the tabs with slots 47, 49 of folded side flaps 19, 21.

After the interlock of the folded side flaps 19, 21 with first end flap 23 is achieved according to the manner described above, end flap 25 is folded 90° along edge fold line 41 and an additional 90° along fold line 33. A fourth container "side" is thereby formed between the fold lines. Second end flap 25 is thereby apportioned into folded container "top" and "side" segments. Second end flap 25 will now overlay the three interlocking flaps which may contain the combination of dish 15 and cushioning blocks 11, 13. Tabs 51, 53 are foled 90° at attachment fold lines 59, 61 to span the height of the folded container "sides" formed by the folded side flaps 19, 21 and the covering fist end flap 23. Ninety degree folds are made at mid tab fold lines 55, 57 to allow the tabs 51, 53 to approach lower slots 63, 65 perpendicular for insertion therein.

The simultaneous engagement of the tabs 43, 45 of first end flap 23 in slots 47, 49 and tabs 51, 53 in slots 63, 65 allows the packing box as assembled in FIG. 2 to maintain its preferred configuration without the aid of addtional fasteners such as glue, staples and the like.

Figure 4:
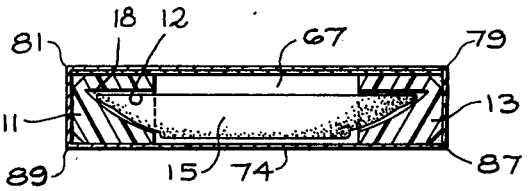
FIG. 4 is a sectional view of the embodiment of the invention of FIG. 3 taken along the line 4—4 of FIG. 3.

It will be seen from FIGS. 2, 4, and 10, the indentations 14 of the cushioning blocks 11 and 14 are formed by two intersecting surfaces 12 and 17. The two surfaces intersect along line 18 forming an arc of a circle having a radius substantially equal to the radius of the plate. The upper surface 12 is substantially planar and engages the top of the rim of plate 15. The bottom surface 18 is preferably shaped to conform with the bottom surface of the plate. It will be seen that any blow producing a force component parallel to the plane defined by the rim of the plate, from any direction, will produce a wedging action between the plate and the blocks tending to wedge apart the surfaces 12 and 17 of the indentations. Because the blocks are made of solid pieces of cushioning material, such as polystyrene foam, this wedging action forces the bottom of the plate into tight fitting contact with the lower surface 17 of the indentations, providing distribution of the impact load over the relatively large surfaces 17. Such edge forces also cause the rim of the plate to cut into the edge defined by the line 18, further absorbing energy of the blow while protecting the edge of the rim of the plate.

Figure 3:
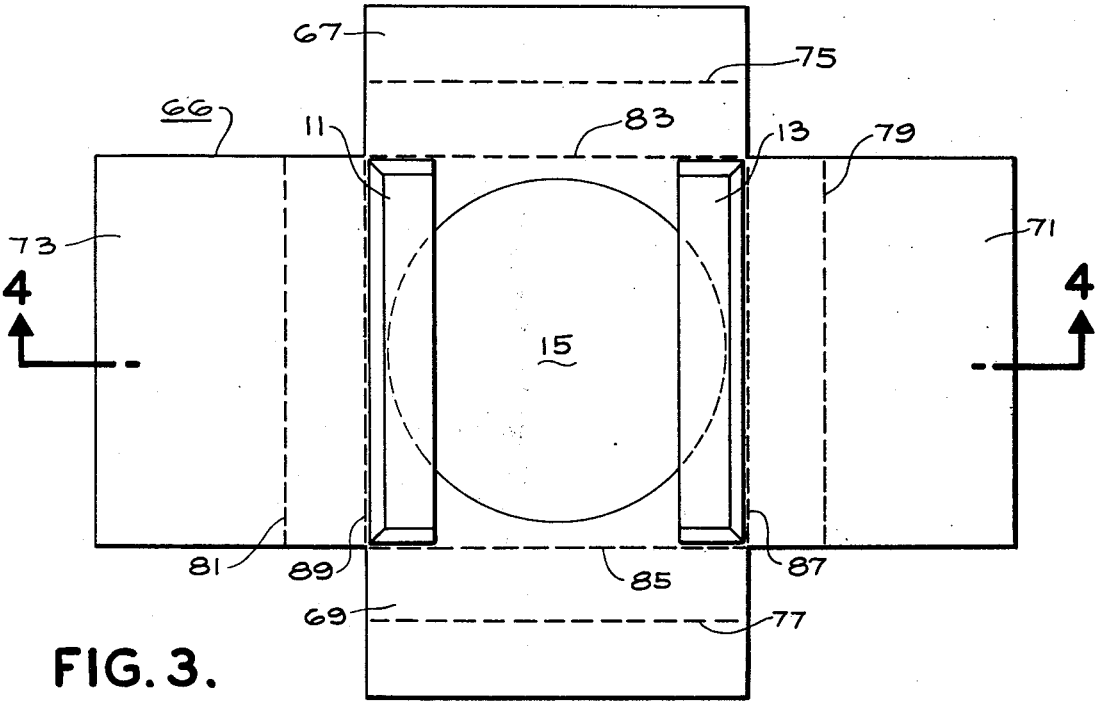
FIG. 3 is a plan view of a tape or staple retained packing box in layout incorporating another embodiment of the invention.

The present inventive concept may also be practiced with a container 66 to enclose the cushioning blocks 11, 13 and plate 15 combination having a construction shown in layout in FIG. 3 and in (sectional) assembly in FIG. 4. The container 66 is not "self-closing." The layout of the container 66 is seen to comprise a pair of oppositely disposed side flaps 67, 69 and end flaps 71, 73 engaged to a square bottom portion 74. Fold lines 75, 77, 79 and 81 exist internal to the four flaps and attachment fold lines 83, 85, 87, 89 exist at the junctions of the four flaps with the bottom portion 74. In FIG. 4 it can be readily seen that the same cushioning effect of blocks 11 and 13 upon plate 15 is achieved in the present embodiment. The simplified design of the shipping container necessitates the use of additional fastening means such as tape or staples to secure the box in the position shown in FIG. 4 during shipping or rough handling. Container 66 may be assembled by, initially, folding side flaps 67, 69 90° at attachment fold lines 83, 85 and at fold lines 75, 77 to create a pair of folded container "sides" and "coverings." Similar folds are then made in end flaps 71, 73 at attachment fold lines 87, 89 and fold lines 79, 81 to create another pair of container "sides" and "coverings." This folding sequence assures that the coverings created from end flaps 71, 73 will overlay those formed from side flaps 67, 60. Tape, glue, staples, or other standard fastening means may be applied after placing the dish 15, retained by cushioning blocks 11, 13, into container 66 to achieve the (sectional) assembly of FIG. 4.

Figure 5:
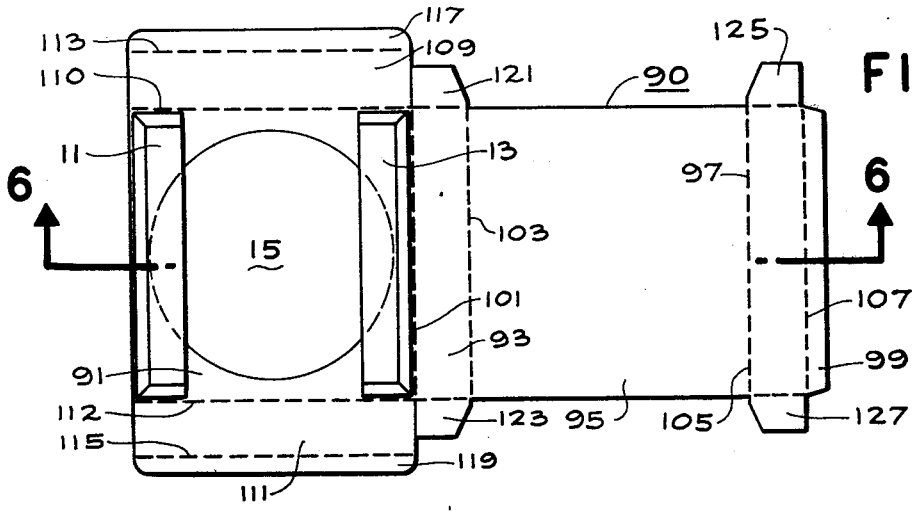
FIG. 5 is a plan view of a tab-maintained packing box in layout incorporating a further embodiment of the invention.
Figure 6:
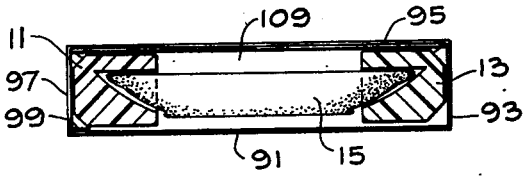
FIG. 6 is a sectional view of the embodiment of the invention as shown in FIG. 5 as fully assembled, taken along the line 6—6 of FIG. 5.

FIGS. 5 and 6 show a further variation of the present inventive concept wherein the cushioning blocks 11, 13 which retain plate 15 are to be enclosed in a container 90 of alternative design. In layout, the container 90 is seen to be formed of a substantially rectangular piece longitudinally subdivided into sections comprising a square back panel 91, side panels 93, and 97, square front panel 95, and fastening panel 99 by means of fold lines 101, 103, 105 and 107. Attached to back panel 91 are top flap 109 and bottom flap 111 at fold lines 110 and 112. Each of these flaps has an interior fold line 113, 115 which, when assembled in FIG. 6 produces the insertion tabs 117, 119 thereon. Insertion tabs 121, 123, 125 and 127 exist at the opposite ends of the side panels 93, 97. The configuration achieved by the embodiment of FIG. 5 when folded is shown in FIG. 6. A succession of counterclockwise 90° folds in the container layout as seen in FIG. 5 are made at fold lines 101, 103, 105 and 107, respectively. This will result in side panels 93, 97 abutting the sides of cushioning blocks 11, 13 and front panel 95 spanning the distance between the outside edges of the cushioning blocks when the combination of cushioning blocks 11, 13 and plate 15 is inserted into the folded container 90. A conventional fastener, such as glue is applied to fastening panel 99. This serves to secure the engagement of the fastening panel 99 to back panel 91, thereby maintaining the box-like folded configuration of the container 90. Ninety degree folds are made at the junctions of insertion tabs 121, 123, 125, 127 with side panels 93, 97 to provide backing at the ends of cushioning blocks 11, 13. By making 90° folds along fold lines 110, 112 and at interior fold lines 113, 115, top and bottom flaps having insertion tabs 117, 119 are created which achieve a reusable closure means at the top and bottom of the assembled box-like container 90. The combination of plate 15 and cushioning blocks 11, 13 may easily and repeatedly be inserted and removed from container 90 by the engagement and disengagement of top flap 109 as bottom flap 111 at insertion tabs 117, 119 to open or close the assembled box-like configuration of container 90. Once again one may readily appreciate the achievement of the identical inventive concept through a slightly modified shipping container. The cushioning blocks 11, 13 are seen to interact with the dish or plate 13 in exactly the same manner as in the previous embodiments. The shipping container is so dimensioned in respect to the cushioning blocks 11, 13 and dish 15 that intimate engagement of the blocks and dish is achieved and maintained. Either the top flap 109 or the bottom flap 111 or both may be moved from the back panel 91 to the front panel 95 if desired.

Figure 9:
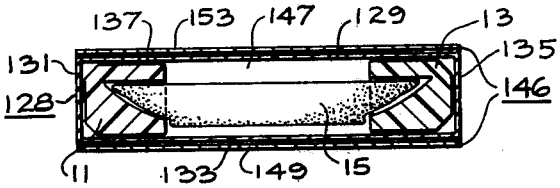
FIG. 9 is a sectional view of the embodiment of FIGS. 7 and 8 taken along line 9—9 of FIGS. 7 and 8.
Figure 8:
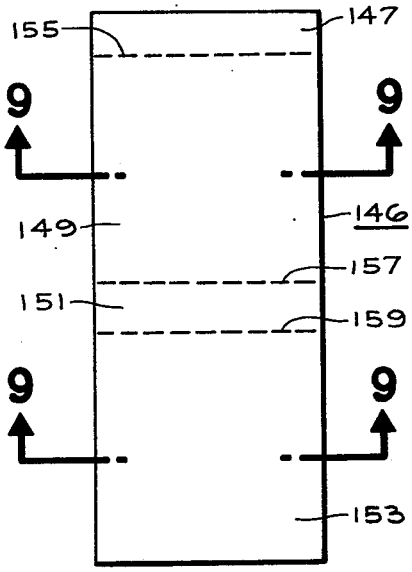
FIG. 8 is a plan view of the exterior section of a drawer-type shipping container in layout for use with the section of FIG. 7.
Figure 7:
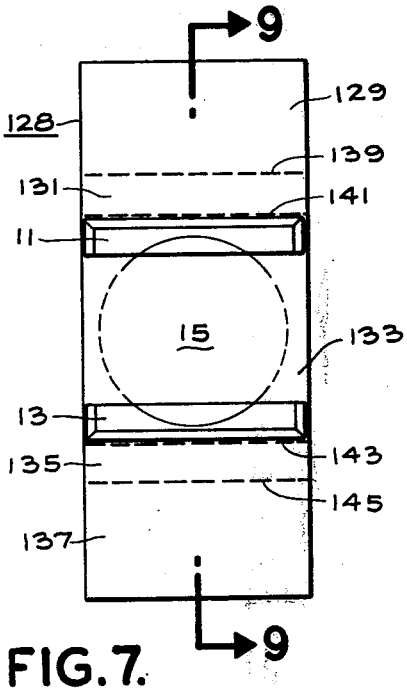
FIG. 7 is a plan view of the interior section of a drawer-type shipping container in layout incoporating another embodiment of the invention.

In FIGS. 7 and 8 there is shown the layout of a two part container adaptable to the present inventive concept which achieves a drawer-like operation. FIG. 7 shows the layout of the interior portion 128 of the container. In FIG. 9 it is seen that this interior portion 128 fits within an exterior portion 146 which is shown in layout in FIG. 8. The interior portion 128 is seen to comprise a rectangular piece of material such as cardboard which is divided into covering panels 129, 137, side panels 131, 135 and square bottom panel 133 by fold lines 139, 141, 143 and 145. The interior portion 128 is so dimensioned that the packing effect achieved by the previous embodiments will be achieved by this embodiment, namely, the blocks of cushioning material 11, 13 will be urged toward each other to tightly engage the plate or dish 15 at the indentations therein. No fastening means is required to maintain the shape of the interior portion 128 as its shape will be dictating by the interaction of enclosing outer section 146 and the combination of blocks 11, 13 and the dish 15 as shown in FIG. 9.

The outer section 146 of the container is similarly seen to comprise a rectangular piece of material which is divided into side panels 147, 151, top panel 149 and a bottom panel 153 by means of fold lines 155, 157 and 159, appropriately spaced. Assembly for shipping or storage is achieved by placing the dish 15 combined with cushioning blocks 11, 13 upon the bottom panel 133. Ninety degree folds at fold lines 141, 139 and at fold lines 143, 145 create a box-like inner enclosure. The outer enclosure is assembled by making successive 90° folds along fold lines 155, 157, 159. After the folding of outer section 146, bottom panel 153 will achieve a line of contact along its edge with side panel 147. Tape, glue, staples or other standard fastening means may be applied at this junction to retain the box-like character of outer portion 146. The folded inner section 128 may now be inserted into the box-like outer section 146. It can be seen in FIG. 9 that this 2-portion shipping container arrangement achieves the inventive concept of the prior disclosed embodiments. This configuration additionally achieves an extra measure of cushioning in that a double top and bottom encloses the cushioning blocks-plate array as seen in FIG. 9. The arrow of FIG. 9 serves to indicate that the interior section 128, containing the blocks 11, 13 and plate 15 is removable from the enclosing outer section 146 in the manner of a drawer.

Thus it is seen that there has been achieved a packing box especially suitable for the shipping and storage of a china or other fragile dish or plate which, in its various configurations, achieves an inexpensive and effective method of protecting the dish or plate from external shocks with a minimum amount of cushioning material.

I claim:

1. A packing box for a circular dish or plate having a circular edge in a single plane and having an annular portion sloping upwardly to said circular edge, including in combination:

a pair of separate cushioning blocks of plastic foam material each having a length, a width and a height, and having upper and lower surfaces;

each of said blocks having an indentation in one side intermediate said upper and lower surfaces thereof and complementary to and receiving an edge segment of the plate, said indentation in each block being arcuate when viewed from above said upper surface of said block and having substantially the same radius as the plate, said indentation in each block having a flat upper wall in the shape of a segment of a circle, when viewed in cross section, conforming to the plane of the circular edge of the plate, and said indentation in each block having a lower wall of generally conical shape which, when viewed in cross section, slopes upwardly to and converges with the circular edge of said flat upper wall and which is complementary to said annular portion of the plate; and a confining container enclosing said blocks having four side walls, a top wall, and a bottom wall, the length of the blocks being substantially equal to the length of opposite side walls of the containers, the height of the blocks being substantially equal to the distance between the top and bottom walls, said opposite walls of the container maintaining the blocks in intimate contact with opposed edge segments of the plate, with such edge segments of the plate firmly fitting into said indentations in said blocks, so as to suspend the plate from said blocks within and spaced from all the confining walls of said container.

* * * * *